United States Patent [19]

Potucek

[11] Patent Number: 4,791,772

[45] Date of Patent: Dec. 20, 1988

[54] CONCRETE REINFORCING BAR SUPPORT

[76] Inventor: Frank R. Potucek, 2049 Range Rd., Clearwater, Fla. 33575

[21] Appl. No.: 45,097

[22] Filed: May 1, 1987

[51] Int. Cl.[4] ..... E04C 5/03

[52] U.S. Cl. ..... 52/738; 52/737; 52/739; 403/314

[58] Field of Search ..... 52/737–740; 403/314, 296

[56] References Cited

U.S. PATENT DOCUMENTS

| | | | |
|---|---|---|---|
| 815,618 | 3/1906 | Mueser | 52/738 |
| 863,959 | 8/1907 | Williamson | 52/737 |
| 1,317,824 | 10/1919 | Royse | 52/738 |
| 1,400,278 | 12/1921 | Fougner | 52/739 |
| 1,514,806 | 11/1924 | Thomas | 52/739 |
| 2,264,480 | 12/1941 | Owen | 403/296 |
| 3,378,985 | 4/1968 | Bugan | 52/739 |
| 3,771,884 | 11/1973 | Williams | 52/737 X |
| 4,179,583 | 12/1979 | Sergev | 403/314 X |

FOREIGN PATENT DOCUMENTS

| | | | |
|---|---|---|---|
| 636302 | 2/1962 | Canada | 52/738 |
| 626831 | 11/1961 | Italy | 52/737 |
| 353156 | 5/1961 | Switzerland | 52/738 |

*Primary Examiner*—David A. Scherbel
*Assistant Examiner*—Richard E. Chilcot, Jr.
*Attorney, Agent, or Firm*—Joseph C. Mason, Jr.; Ronald E. Smith

[57] ABSTRACT

A horizontally extending reinforcing bar having a central core in transverse cross-section exhibiting at least three radial fins projecting outwardly symmetrically from the center of the bar to its outer edge. Each pair of adjacent fins define a valley between them containing a pattern of raised surface area. Two in-line reinforcing bars are held together by a coupling device having a housing with multiple flexible inwardly projecting plates from grooves in an inner wall. The plates flex in the direction of insertion of a reinforcing bar and exert a force to prevent removal of the bar.

2 Claims, 2 Drawing Sheets

CONCRETE REINFORCING BAR SUPPORT

BACKGROUND OF THE INVENTION

1. Field of the Invention

This invention relates to reinforcing bars for strengthening concrete forms. More particularly, it refers to a star shaped reinforcing bar in transverse cross section having increased holding resistance in a concrete form.

2. Description of the Prior Art

Reinforcing bars are customarily used to provide internal support for concrete forms. Over the years many variations in deformation of such reinforcing bars have been introduced as shown in the following exemplary patents:

| | | |
|---|---|---|
| U.S. Pat. No. | 4,229,501 | 3,415,552 |
| | 4,119,764 | 3,335,539 |
| | 3,979,186 | and |
| | 3,561,185 | 3,312,035 |

Reinforcing bars have been generally employed to furnish tensile strength to concrete sections subject to bending loads and additional compressive strength when unreinforced concrete would prove too bulky. The deformed reinforcing bars have been used specifically to inhibit longitudinal movement of the bars relative to the surrounding concrete. Although some effort in the prior art has been directed to improve the tensible strength of a given size reinforcing bar, there has not been any substantial effort to reduce the amount of metal required for a reinforcing bar while retaining the same tensible strength, bending load, compressive strength and inhibition against longitudinal movement in concrete.

SUMMARY OF THE INVENTION

I have invented a novel reinforcing bar structure that maintains all of the desired characteristics of a reinforcing bar such as tensile strength, bending load, compressive strength and inhibition against longitudinal movement in concrete, and in the same structure saves significant amounts of metal resulting in lower cost reinforcing bars.

My preferred reinforcing bar has a star shaped core in transverse cross-section. The star shape is expressed by five radial fins directed outwardly from the center of the bar. A valley between each fin contains a pattern of raised surface area. A coupling device having a cylindrical housing with an outer and inner wall is used to hold two in-line reinforcing bars together. The inner wall of the housing contains multiple flexible inwardly projecting plates that flex in a direction of reinforcing bar insertion and exert a force against the bar to prevent its removal.

BRIEF DESCRIPTION OF THE DRAWINGS

The present invention may be best understood by those having ordinary skill in the art of reinforcing bars by reference to the following detailed description when considered in conjunction with the accompanying drawings in which.

DETAILED DESCRIPTION OF THE INVENTION

Figure 1:
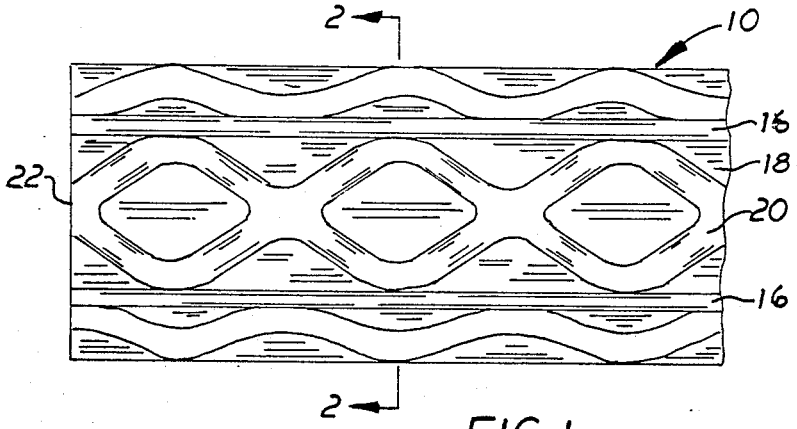
FIG. 1 is an elevation view of a cut off reinforcing bar of the invention.

Throughout the following detailed description the same reference numerals refer to the same elements in all figures.

The preferred elongated concrete reinforcing bar 10 (hereinafter termed a rebar) has an elongated central core 12, five tapered radially protruding fins 14 from core 12 and an outer edge 16 on each fin 14. The rebar may have as few as three fins and as many as eleven fins symetrically spaced apart.

Figure 2:
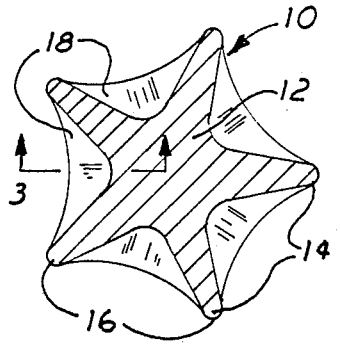
FIG. 2 is a transverse cross-sectional view of the preferred star shaped reinforcing bar shown in FIG. 1.

As shown in FIG. 2, a transverse cross-section of the rebar appears star-shaped since each of the fins 14 taper from the central core 12 outwardly to a rounded edge 16 at a point farthest from the central core 12.

The space between adjacent fins 14 form a valley or cup 18 where a raised surface 20 is located.

Referring to FIG. 1 the rebar 10 is formed by stamping an elongated strip of steel to produce the star shaped configuration seen in more detail as a cross-section in FIG. 2. A welding temperature heat source is applied to the cup 18 to form a ribbon like pattern 20. The rebar 10 has up to seventeen percent more surface area with less than one-half the cross-sectional area of metal found in prior art rebars.

Figure 4:
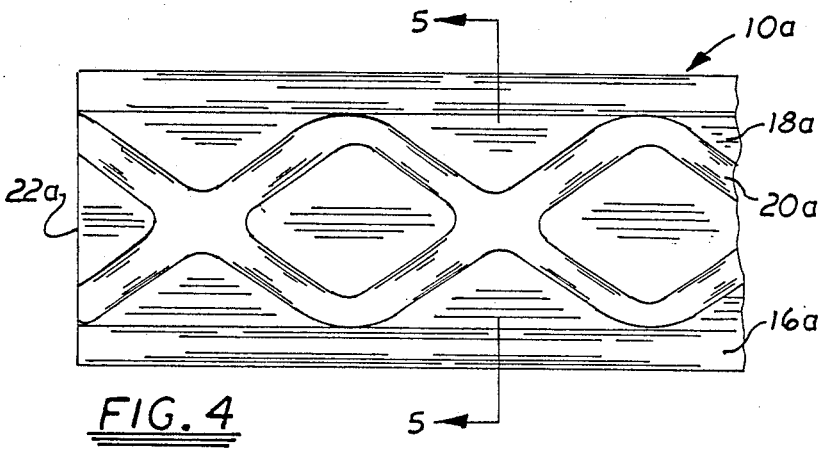
FIG. 4 is an elevation view of a cut off alternative reinforcing bar of the invention.
Figure 5:
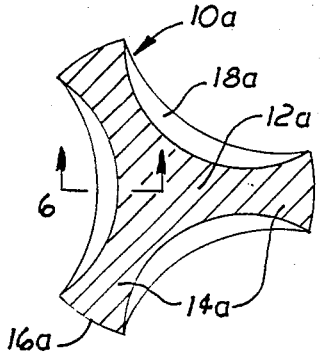
FIG. 5 is a transverse cross-sectional view of the three radial fin reinforcing bar shown in FIG. 4.
Figure 3:
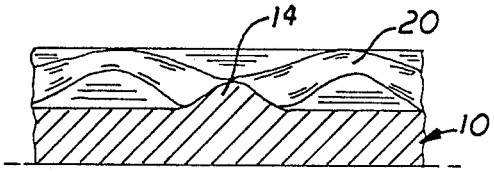
FIG. 3 is a sectional view along line 3—3 of FIG. 2.
Figure 6:
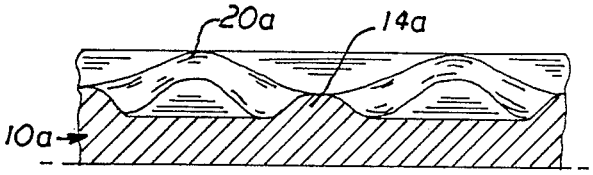
FIG. 6 is a sectional view along line 6—6 of FIG. 5.
Figure 7:
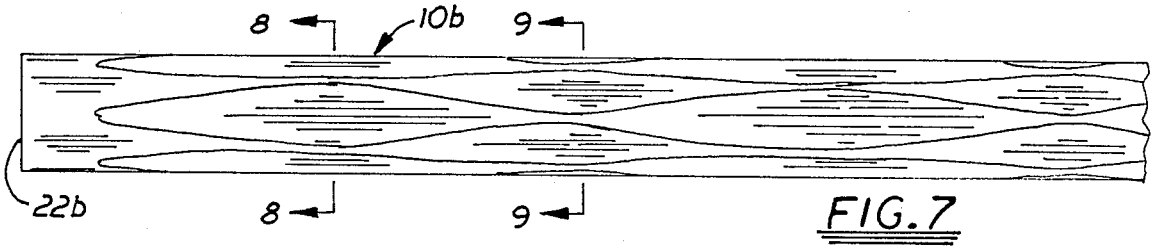
FIG. 7 is an elevation view of a cut off second alternative reinforcing bar of the invention.
Figure 8:
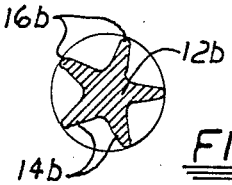
FIG. 8 is a transverse cross-sectional view along line 8—8 of FIG. 7.
Figure 9:
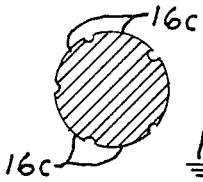
FIG. 9 is a transverse cross-sectional view along line 9—9 of FIG. 7.
Figure 13:
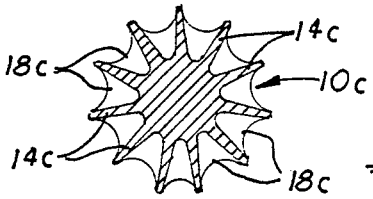
FIG. 13 is a transverse cross-sectional view of an eleven radial fin reinforcing bar.

Alternate designs for the rebar are shown in FIGS. 4, 7 and 13. In FIG. 4 rebar 10*a* has only three radial fins 14*a* which end at 16*a*. The cup 18*a* is more shallow than 18 because of a greater distance between fins 16*a*. The same pattern 20*a* is located in the cups 18*a*. In FIG. 7, a diamond shaped pattern is stamped in rebar 10*b* so that alternate star shaped (FIG. 8) and notched circle (FIG. 9) configurations are exhibited in the same rebar. The outer edge 16*b* of the fins 14*b* are similar to the rebar of FIG. 1 and are clearly dissimilar in the section represented in FIG. 9. In FIG. 13, the rebar 10*c* has eleven fins 14*c* with cups 18*c* between each pair of fins.

Figure 10:
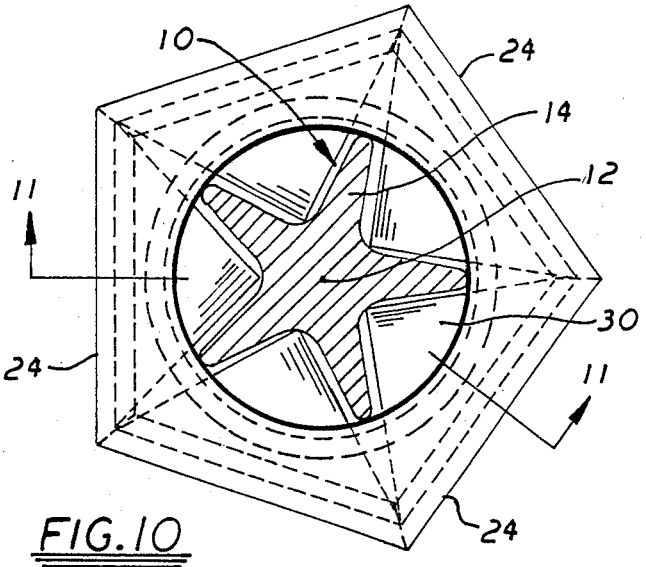
FIG. 10 is a plan view of the coupling device used to join two reinforcing bars together.
Figure 11:
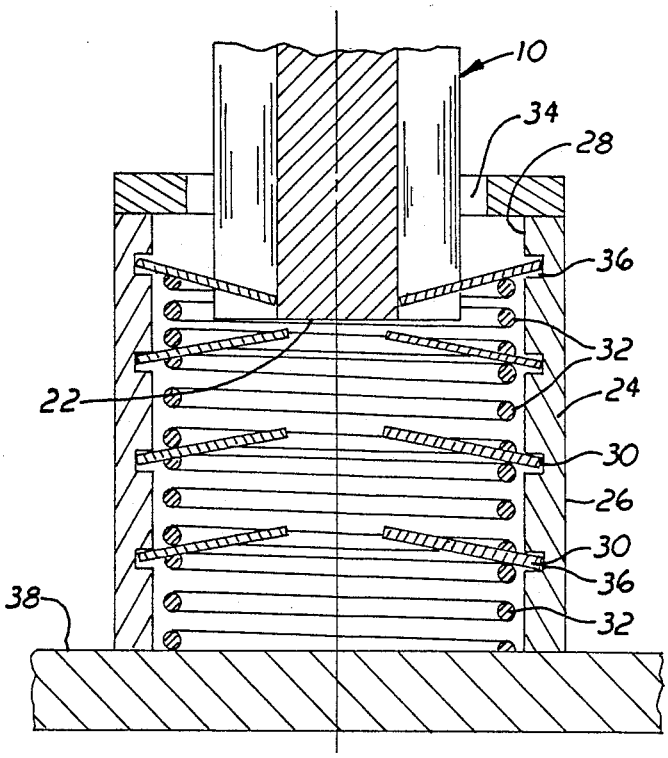
FIG. 11 is a sectional view along line 11—11 of FIG. 10.
Figure 12:
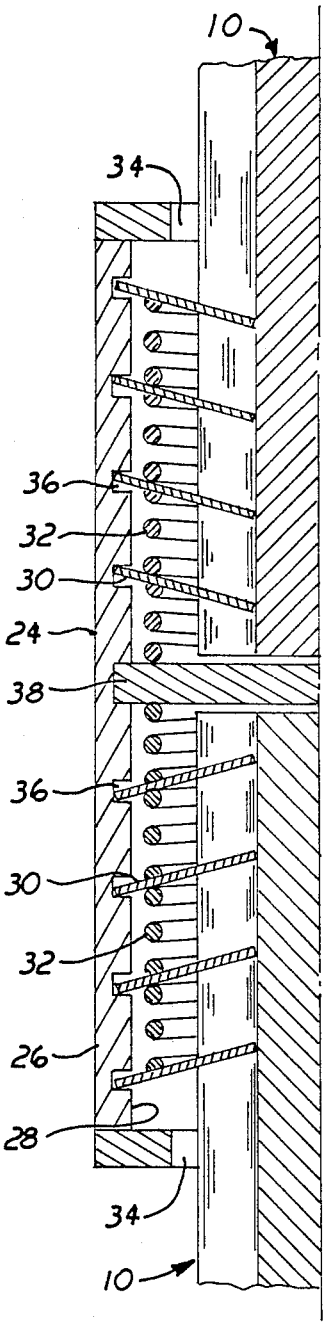
FIG. 12 is a sectional view showing two rebars in line held by the coupling device.

The end section 22 of rebar 10 or 22*a* of rebar 10*a* or 22*b* of rebar 10*b* can be joined end to end with another like rebar in an inline configuration so that rebars can achieve almost continuous length depending upon the vertical height or lateral width of the structure to be supported. In FIG. 10 a coupling device 24 is shown with an inserted rebar 10 according to FIG. 1. The coupling device 24 is used either to hold the end of a rebar as in FIG. 11 or to join two rebars together as shown in FIG. 12.

The coupling device 24 has an outer wall 26 and an inner wall 28. Mounted within grooves 36 of the inner wall 28 are a series of flexible plates 30. The plates 30 flex between springs 32 so that movement of the rebar 10 in a direction through the opening 34 of the coupling device 24 flex the plates 30 in a downward direction. The plates 30 hold the rebar in place by friction force and prevent its withdrawal.

A butt plate 38 prevents movement of rebar 10 beyond its desired position within coupling device 24.

The coupling device can have the same number of sides 24 as conform to the number of fins 14 on the rebar or can be cylindrical in shape to accommodate rebars of differing numbers of fins.

The above described embodiment does not cover exclusively all possibilities of the invention. Numerous variations are possible and will be obvious to the expert after he has taken knowledge of the above.

Having thus described the invention, what is claimed and desired to be secured by Letters Patent is:

1. An elongated reinforcing bar for use in concrete comprising:

a central core, five tapered fins projecting radially outwardly from the central core, a cup between each fin, a plurality of longitudinally spaced raised surface areas projecting upwardly from each cup, the distance between a distal end of each fin and its proximal end joinder with the central core being greater than half the radius of the bar and, each of said raised surface areas having a cup shape.

2. A reinforcing bar according to claim 1 wherein the five fins exhibit a star shaped configuration in transverse cross-section throughout the extent of the bar.

* * * * *